US010720760B2

(12) United States Patent
Kawata et al.

(10) Patent No.: US 10,720,760 B2
(45) Date of Patent: Jul. 21, 2020

(54) SPARK PLUG FOR INTERNAL COMBUSTION ENGINE

(71) Applicant: DENSO CORPORATION, Kariya, Aichi-pref. (JP)

(72) Inventors: Yuuki Kawata, Nisshin (JP); Fumiaki Aoki, Nisshin (JP); Daisuke Tanaka, Nisshin (JP); Ryota Wakasugi, Nisshin (JP); Akimitsu Sugiura, Kariya (JP); Kanechiyo Terada, Kariya (JP); Tetsuya Miwa, Kariya (JP)

(73) Assignee: DENSO CORPORATION, Kariya (JP)

( * ) Notice: Subject to any disclaimer, the term of this patent is extended or adjusted under 35 U.S.C. 154(b) by 0 days.

(21) Appl. No.: 16/590,653

(22) Filed: Oct. 2, 2019

(65) Prior Publication Data

US 2020/0112144 A1 Apr. 9, 2020

(30) Foreign Application Priority Data

Oct. 3, 2018 (JP) ..... 2018-188528

(51) Int. Cl.
*H01T 13/32* (2006.01)
*H01T 13/34* (2006.01)

(52) U.S. Cl.
CPC ..... *H01T 13/32* (2013.01); *H01T 13/34* (2013.01)

(58) Field of Classification Search
CPC ..... H01T 13/32; H01T 13/34; H01T 13/20; H01T 13/39; H01T 13/36; H01T 13/28; H01T 13/30
See application file for complete search history.

(56) References Cited

U.S. PATENT DOCUMENTS

| | | | | |
|---|---|---|---|---|
| 4,798,991 | A | 1/1989 | Benedikt et al. | |
| 4,939,409 | A | 7/1990 | Friese et al. | |
| 5,731,654 | A | 3/1998 | Benedikt et al. | |
| 6,495,948 | B1 * | 12/2002 | Garrett, III | H01T 13/32 123/169 EL |
| 2005/0264151 | A1 * | 12/2005 | Mori | H01T 13/20 313/141 |

(Continued)

FOREIGN PATENT DOCUMENTS

| | | |
|---|---|---|
| GB | 2 149 852 | 6/1985 |
| JP | S61-022589 | 1/1986 |

(Continued)

*Primary Examiner* — Joseph L Williams
*Assistant Examiner* — Jose M Diaz
(74) *Attorney, Agent, or Firm* — Nixon & Vanderhye P.C.

(57) ABSTRACT

A spark plug for an internal combustion engine includes a housing, an insulator, and a center electrode. The center electrode includes an inside electrode portion and an outside electrode portion. The housing includes a ground electrode projecting from a distal end portion of the housing toward the distal end side of the plug at a part in a plug circumferential direction. The outside electrode portion projects along a surface of the insulator tip in a direction away from a boundary with the inside electrode portion and includes a projection, which is capable of causing an electrical discharge between the ground electrode and the outside electrode portion. The projection is formed in a region in the plug circumferential direction. The projection and the ground electrode are located at positions different from each other in the plug circumferential direction.

7 Claims, 12 Drawing Sheets

(56) References Cited

U.S. PATENT DOCUMENTS

| | | | | |
|---|---|---|---|---|
| 2009/0167135 | A1* | 7/2009 | Morin | H01T 13/39 313/141 |
| 2012/0312268 | A1 | 12/2012 | Shionoya et al. | |
| 2016/0072259 | A1 | 3/2016 | Kinoshita et al. | |
| 2019/0319433 | A1* | 10/2019 | Shibata | H01T 13/20 |

FOREIGN PATENT DOCUMENTS

| | | |
|---|---|---|
| JP | S61-292875 | 12/1986 |
| JP | S63-167077 | 7/1988 |
| JP | H01-265476 | 10/1989 |
| JP | 2010-065566 | 3/2010 |
| JP | 2015-181088 | 10/2015 |
| JP | 2016-062769 | 4/2016 |
| WO | 2013/099672 | 7/2013 |

* cited by examiner

SPARK PLUG FOR INTERNAL COMBUSTION ENGINE

CROSS-REFERENCE TO RELATED APPLICATION

This application is based on and claims the benefit of priority from earlier Japanese Patent Application No. 2018-188528 filed Oct. 3, 2018, the entire contents of which are incorporated herein by reference.

BACKGROUND

Technical Field

The present disclosure relates to a spark plug for an internal combustion engine.

Related Art

Spark plugs for an internal combustion engine that cause a creeping discharge along the surface of an insulator between a ground electrode and a center electrode are known.

In such a spark plug, the ground electrode includes a ground projection in which the distal end portion of the ground electrode partially projects toward a distal end side. The ground projection is formed at a part of the ground electrode in the circumferential direction. Furthermore, the spark plug is mounted on the internal combustion engine so that the position where an electrical discharge is formed in the circumferential direction of the spark plug is appropriate for the direction of the flow of an air-fuel mixture in a combustion chamber.

SUMMARY

An aspect in accordance with the present disclosure provides a spark plug for an internal combustion engine that includes a cylindrical housing, a cylindrical insulator retained inside the housing, and a center electrode including an outside electrode portion exposed from the insulator toward the distal end side. The housing includes a ground electrode projecting from a distal end portion of the housing at a part in a plug circumferential direction. The outside electrode portion includes a projection, which is capable of causing an electrical discharge between the ground electrode and the outside electrode portion. The projection is formed in a region in the plug circumferential direction. The projection and the ground electrode are located at positions different from each other in the plug circumferential direction.

DETAILED DESCRIPTION OF THE PREFERRED EMBODIMENTS

Figure 1:
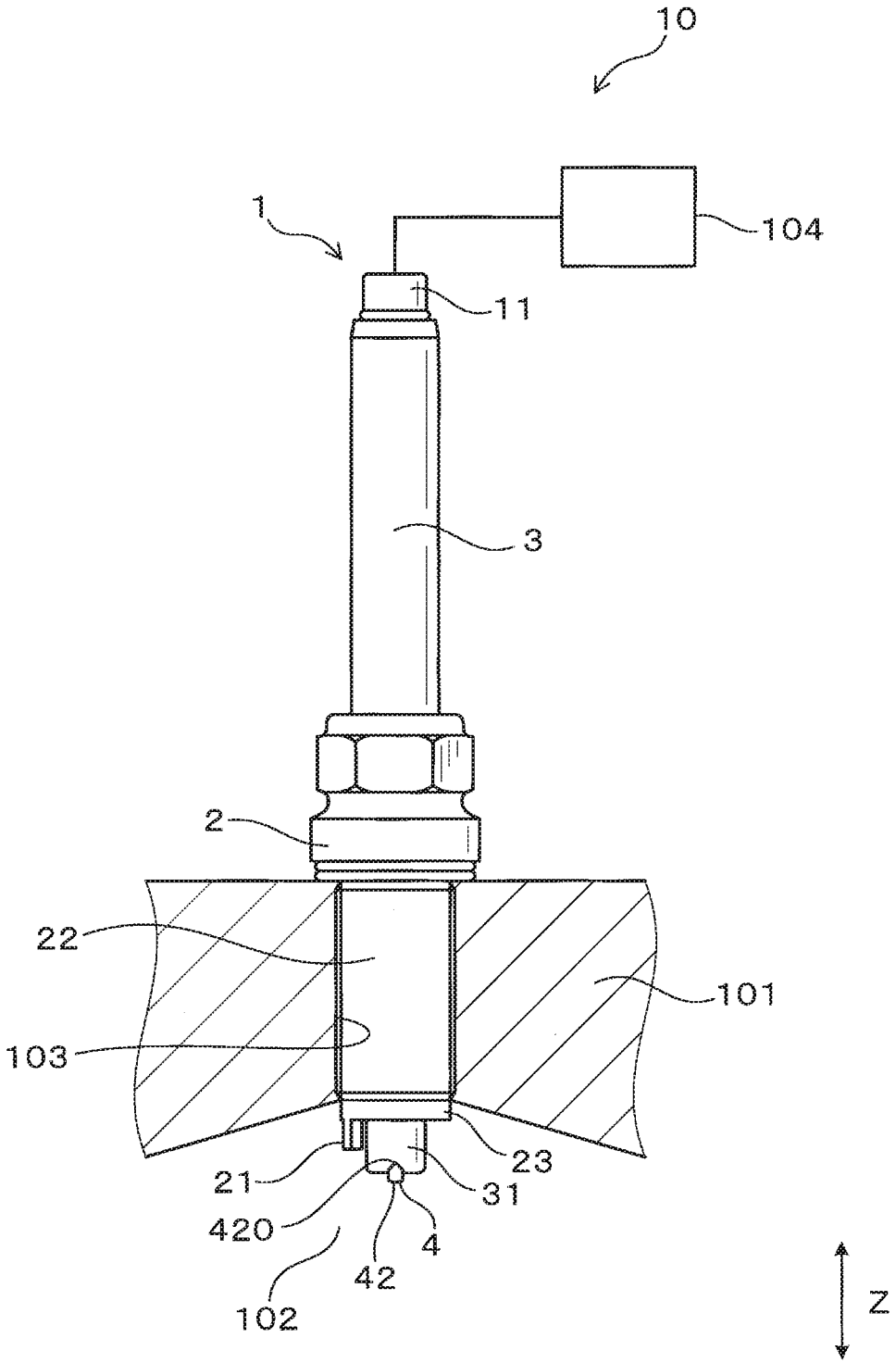
FIG. 1 is a partial cross-sectional view of an ignition system including a spark plug according to a first embodiment.

The present disclosers conducted studies on spark plugs for an internal combustion engine that improve ignition performance.

According to the conventional common spark plugs, if an electric discharge caused between a ground electrode and a center electrode extends along the surface of an insulator, a discharge spark caused by the electric discharge is hard to be extended, and it is difficult to improve the ignition performance.

In order to cope with such situations, in the above-mentioned spark plugs, the ground electrode includes a ground projection in which the distal end portion of the ground electrode partially projects toward a distal end side. The ground projection is formed at a part of the ground electrode in the circumferential direction. With this configuration, the position where an electrical discharge is formed in the circumferential direction of the spark plug is brought to the desired position (that is, the position where the ground projection is formed in the circumferential direction). The spark plug is mounted on the internal combustion engine so that the position where the electrical discharge is formed in the circumferential direction of the spark plug is appropriate for the direction of the flow of an air-fuel mixture in a combustion chamber. This makes it easy for the discharge spark to be separated from the surface of the insulator by the flow in the combustion chamber and to be extended into the gas.

However, the direction of the flow in the combustion chamber is not always constant and may fluctuate. Thus, the ignition performance of the spark plugs to the air-fuel mixture may undesirably vary due to the fluctuation of the direction of the flow in the combustion chamber. Given the circumstances, there is room for improvement in the ignition performance of the spark plugs to the air-fuel mixture.

The present disclosure has been accomplished in view of the above issues and provides a spark plug for an internal combustion engine that improves the ignition performance.

An aspect in accordance with the present disclosure provides a spark plug for an internal combustion engine that includes a cylindrical housing, a cylindrical insulator, and a center electrode. The cylindrical insulator is retained inside the housing with an insulator tip projecting from the housing toward a distal end side. The center electrode includes an inside electrode portion located inside the insulator and an outside electrode portion exposed from the insulator toward the distal end side. The housing includes a ground electrode projecting from a distal end portion of the housing toward the distal end side of the plug at a part in a plug circumferential direction. The outside electrode portion projects along a surface of the insulator tip in a direction away from a boundary with the inside electrode portion and includes a projection, which forms an electrical discharge between the ground electrode and the outside electrode portion. The projection is formed in a region in the plug circumferential direction. The projection and the ground electrode are located at positions different from each other in the plug circumferential direction.

In the spark plug for an internal combustion engine of the above aspect, the projection and the ground electrode are located at positions different from each other in the plug circumferential direction. Thus, the creeping discharge caused between the center electrode and the ground electrode along the surface of the insulator is formed to be a spiral so that the creeping discharge extends in one direction in the plug circumferential direction as the creeping discharge extends from one end to the other end in the plug axial direction. That is, the creeping discharge is formed in the range of a certain length in the plug circumferential direction. Thus, even if the direction of the flow in the combustion chamber fluctuates, at least part of the discharge spark caused by the creeping discharge is likely to be located in the region where the creeping discharge is likely to be extended by the flow in the combustion chamber. Consequently, the spark plug of the present aspect is unlikely to cause variation in the ignition performance due to the fluctuation of the flow direction of the air-fuel mixture in the combustion chamber and improves the ignition performance.

As described above, the present disclosure provides the spark plug for an internal combustion engine that improves the ignition performance.

Hereinafter, preferred embodiments of the present disclosure will be described with reference to the drawings. The sizes of the members in the drawings are exaggerated to facilitate illustration as required and do not show the actual dimension or the ratio between the members. In the present description and the drawings, components that have substantially the same functional structure are given the same reference signs, and redundant descriptions are omitted.

First Embodiment

First, a spark plug for an internal combustion engine according to a first embodiment will be described with reference to FIGS. 1 to 11. The spark plug 1 of the present embodiment can be used as, for example, ignition means for an internal combustion engine of a vehicle such as an automobile. In the present disclosure, the internal combustion engine is not limited to the one for use in automobiles, but may be used in, for example, transportation units, such as automobiles, boats and ships, motorcycles, and aircraft, and a generator. Specific examples of the internal combustion engine include, for example, a displacement internal combustion engine, such as a reciprocating engine (for example, a gasoline engine and a diesel engine) and a rotary engine, or a fluid flow engine, such as a gas turbine engine and a jet engine.

As shown in FIG. 1, the spark plug 1 is mounted on an engine head 101 of an internal combustion engine. In this state, one end of the spark plug 1 in a plug axial direction Z is located in a combustion chamber 102. In this specification, one direction in the plug axial direction Z, that is, the direction in which the spark plug 1 is located in the combustion chamber 102 will be referred to as a distal end side, and the opposite side will be referred to as a proximal end side.

In this specification, the central axis of the spark plug 1 will be referred to as a plug central axis. The plug axial direction Z refers to the direction in which the plug central axis extends. A plug radial direction refers to the radial direction of the spark plug 1. A plug circumferential direction refers to the circumferential direction of the spark plug 1.

The spark plug 1 for an internal combustion engine according to the present embodiment includes a housing 2, an insulator 3, and a center electrode 4 as shown in FIGS. 1 to 4. The housing 2 has a cylindrical shape. The insulator 3 is retained inside the housing 2 with an insulator tip 31 projecting toward the distal end side of the housing 2. The insulator 3 has a cylindrical shape.

Figure 4:
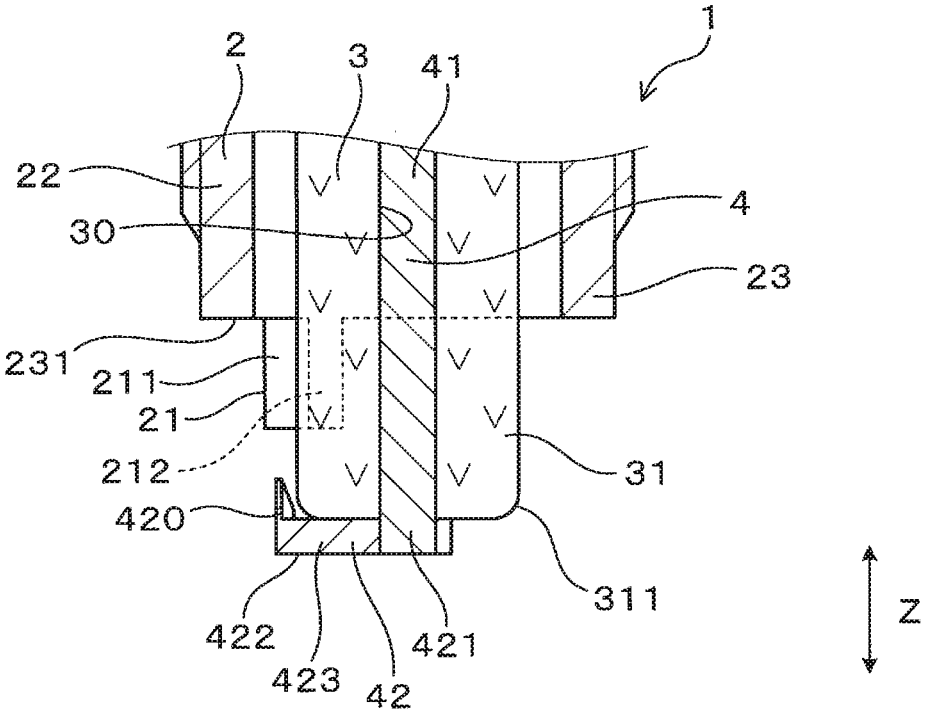
FIG. 4 is a cross-sectional view of the spark plug taken along line IV-IV of FIG. 2 as viewed from the direction of the arrows.

As shown in FIG. 4, the center electrode 4 includes an inside electrode portion 41 and an outside electrode portion 42. The inside electrode portion 41 is a section of the center electrode 4 located inside the insulator 3. The outside electrode portion 42 is a section of the center electrode 4 exposed from the insulator 3 toward the distal end side of the insulator 3.

Figure 2:
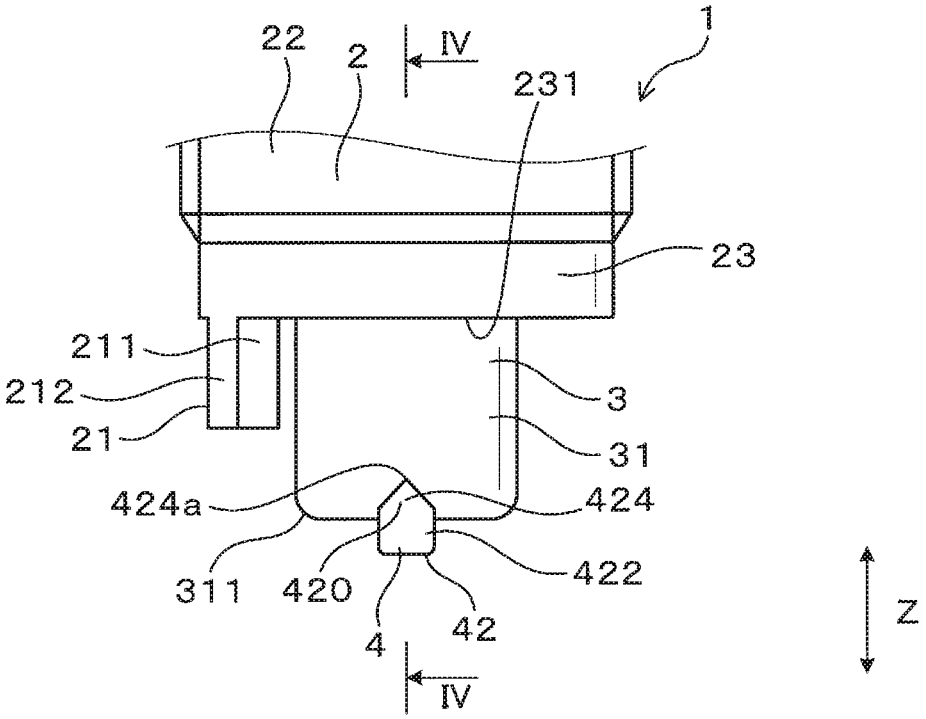
FIG. 2 is a front view of the distal end portion of the spark plug according to the first embodiment.
Figure 3:
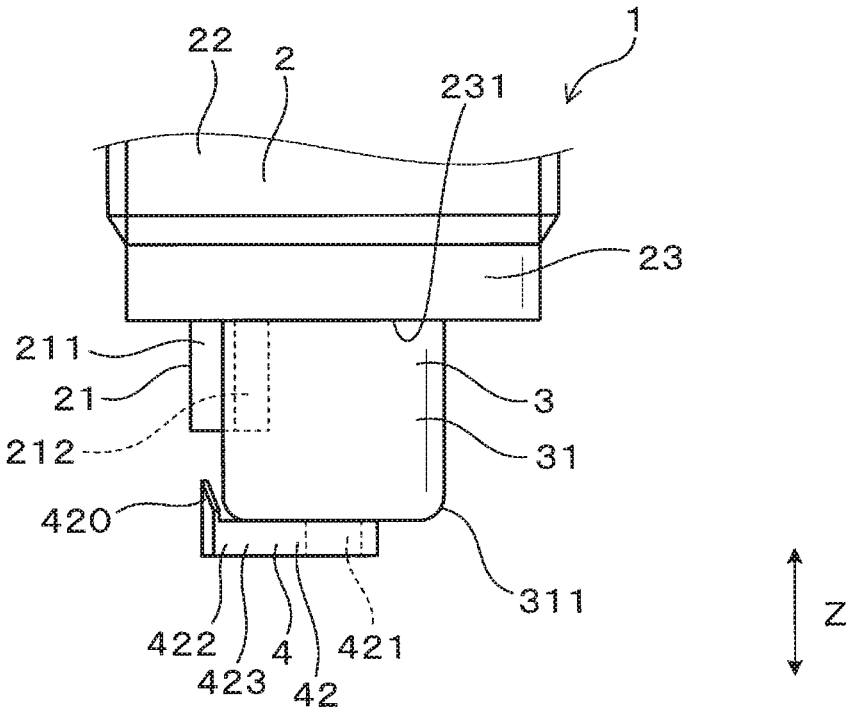
FIG. 3 is a side view of the distal end portion of the spark plug according to the first embodiment.

As shown in FIGS. 1 to 5, a ground electrode 21 projects toward the distal end side from a part of the distal end portion of the housing 2 in the plug circumferential direction. As shown in FIGS. 3 and 4, the outside electrode portion 42 includes a projection 420, which projects in a direction away from the boundary with the inside electrode portion 41 along the distal end surface of the insulator tip 31. An electrical discharge is formed between the ground electrode 21 and the projection 420. The projection 420 is formed in a region in the plug circumferential direction. The projection 420 and the ground electrode 21 are located at positions different from each other in the plug circumferential direction. That is, the projection 420 and the ground electrode 21 are located at a predetermined angle about the plug central axis, which serves as an apex.

Structures of the spark plug 1 will be described in detail below.

As shown in FIG. 1, the housing 2 includes, on the outer circumferential portion, a mounting threaded portion 22, which is engageable with an internally threaded bore 103 formed in the engine head 101 of the internal combustion engine. When the spark plug 1 is mounted on the engine head 101, the housing 2 is grounded to the engine head 101. The section of the spark plug 1 toward the distal end side from the mounting threaded portion 22 is exposed to the combustion chamber 102.

Figure 5:
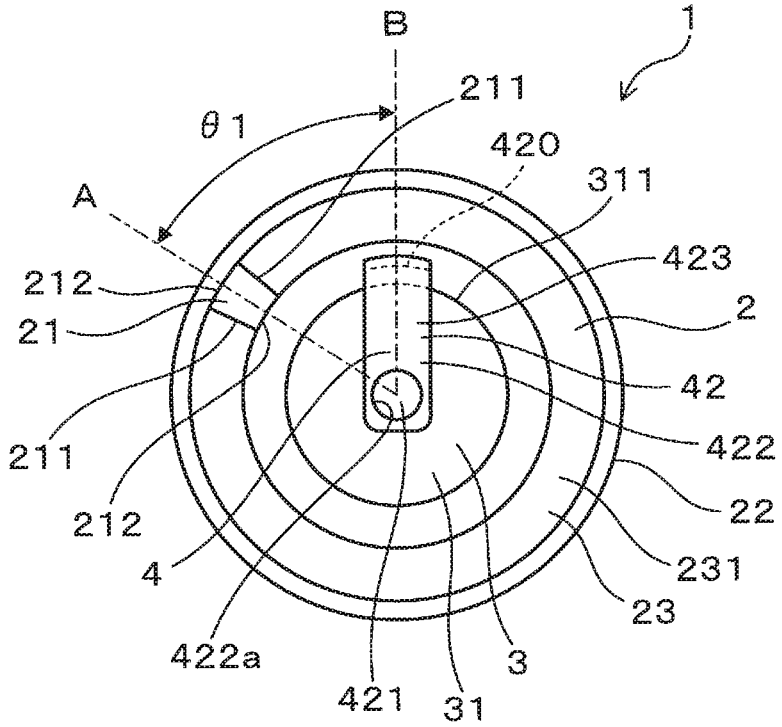
FIG. 5 is a plan view of the distal end portion of the spark plug according to the first embodiment.

As shown in FIGS. 2 to 4, a distal end cylindrical portion 23 is formed at the distal end of the mounting threaded portion 22 of the housing 2. The distal end cylindrical portion 23 has a circular cylindrical shape. As shown in FIG. 5, the distal end cylindrical portion 23 is formed to surround the entire circumference of the insulator 3 from the outer circumference in the plug radial direction. In the plug radial direction, a gap is formed between the outer circumferential surface of the insulator 3 and the inner circumferential surface of the distal end cylindrical portion 23 along the entire circumference. However, the outer circumferential surface of the insulator 3 and the inner circumferential surface of the distal end cylindrical portion 23 may abut against each other. The ground electrode 21 is vertically provided to a distal end surface 231 of the distal end cylindrical portion 23 toward the distal end side.

As shown in FIGS. 2 to 5, the ground electrode 21 projects toward the distal end side from a part of the distal end surface 231 of the distal end cylindrical portion 23 in the plug circumferential direction. The ground electrode 21 is shaped like a quadrangular prism extending in the plug axial direction Z. The side surfaces of the ground electrode 21 include a pair of first side surfaces 211, which face each other in the plug circumferential direction, and a pair of second side surfaces 212, which face each other in the plug radial direction. The distal end surface of the ground electrode 21 is orthogonal to the plug axial direction Z. As shown in FIG. 1, the ground electrode 21 is grounded to the engine head 101 through the distal end cylindrical portion 23 and the mounting threaded portion 22.

The ground electrode 21 and other sections may be integrally formed, or the ground electrode 21 and other sections may be separately formed and joined to one another to form the housing 2. Alternatively, for example, the distal end cylindrical portion 23, the ground electrode 21, and other sections may be separately formed and joined to one another to form the housing 2. The insulator 3 is located inside the housing 2.

As shown in FIG. 1, while the middle section of the insulator 3 in the plug axial direction Z is located inside the housing 2, the proximal end projects from the housing 2 toward the proximal end side. The insulator tip 31 is exposed to the distal end side from the distal end cylindrical portion 23 of the housing 2. The insulator 3 is cylindrical. As shown in FIG. 4, the insulator 3 includes a shaft hole 30, which extends through the insulator 3 in the plug axial direction Z.

As shown in FIGS. 2 to 4, the outer circumferential surface of the insulator tip 31 is shaped like a circular cylinder extending straight in the plug axial direction Z. The distal end surface of the insulator tip 31 is a plane orthogonal to the plug axial direction Z. An insulator corner 311, which connects the outer circumferential surface and the distal end surface of the insulator tip 31, is rounded.

Instead, the outer circumferential surface of the insulator tip 31 may, for example, tilt inward of the plug radial direction as the outer circumferential surface approaches the distal end side in the plug axial direction Z. Alternatively, the distal end surface of the insulator tip 31 may be, for example, an inclined surface or a curved surface that approaches the inner circumferential side as the distal end surface approaches the distal end side.

As shown in FIG. 4, the center electrode 4 is inserted and retained in the distal end section of the shaft hole 30 of the insulator 3. The inside electrode portion 41 of the center electrode 4 is generally shaped like a solid circular cylinder. The outside electrode portion 42 of the center electrode 4 is exposed from the shaft hole 30.

As shown in FIGS. 3 to 5, the outside electrode portion 42 includes a cylindrical portion 421, which extends toward the distal end side from the inside electrode portion 41, and a mounting member 422, which is mounted on the cylindrical portion 421. As shown in FIG. 5, the mounting member 422 includes a through-hole **422*a*, which extends through the mounting member 422 in the plug axial direction Z. After the mounting member 422 is mounted on the cylindrical portion 421 in such a manner that the cylindrical portion 421 is inserted in the through-hole 422*a*, the mounting member 422 is joined to the cylindrical portion 421 by, for example, welding. In the outside electrode portion 42, for example, the cylindrical portion 421 and the mounting member 422 may be integrally formed, or the entire center electrode 4** may be formed of an integral part.

As shown in FIGS. 3 to 5, the mounting member 422 of the outside electrode portion 42 includes an extended portion 423, which extends from the cylindrical portion 421 toward the outer circumference. The projection 420 is formed to project from the extended portion 423 toward the proximal end side. The extended portion 423 and the projection 420 are formed along the surface of the insulator tip 31.

As shown in FIGS. 3 to 5, the extended portion 423 extends straight in the plug radial direction in a region different from the position of the ground electrode 21 in the plug circumferential direction. The outer circumferential end of the extended portion 423 is formed outward of the insulator corner 311 of the insulator tip 31.

As shown in FIGS. 3 and 4, the projection 420 is formed to project toward the proximal end side from the outer circumferential end of the extended portion 423. The projection 420 extends to a position that is closer to the proximal end side than the insulator corner 311 and closer to the distal end side than the ground electrode 21. That is, the projection 420 faces the insulator tip 31 in the plug radial direction, and a gap is formed between the projection 420 and the ground electrode 21 in the plug axial direction Z. As shown in FIG. 5, the inner circumferential surface and the outer circumferential surface of the projection 420 curve along the outer circumferential surface of the insulator tip 31.

As shown in FIG. 2, the projection 420 includes a pointed portion 424 at the proximal end side portion. The pointed portion 424 tilts outward in the plug circumferential direction as the pointed portion 424 extends toward the proximal end side. The pointed portion 424 is shaped like a triangle that projects toward the proximal end side as viewed from the outer circumferential side. A projection end **424*a*, which is the end of the pointed portion 424 toward the projecting side (that is, the proximal end side in the plug axial direction Z), and a later-described electrical discharge formation corner 213 formed on the ground electrode 21 are located at positions separate from each other in the plug circumferential direction. The electrical discharge formation corner 213 is a corner formed between one of the pair of second side surfaces 212 of the ground electrode 21 on the inner circumferential side and one of the pair of first side surfaces 211 closer to the center electrode 4**.

As shown in FIG. 5, when the spark plug 1 is viewed from the plug axial direction Z, a straight line that connects the center of the ground electrode 21 in the plug circumferential direction and the plug central axis in the plug radial direction is referred to as a first straight line A, and a straight line that connects the center of the projection 420 in the plug circumferential direction and the plug central axis in the plug radial direction is referred to as a second straight line B. In this case, an angle θ1 between the first straight line A and the second straight line B is preferably greater than or equal to 20° in terms of forming an electrical discharge in a wide range in the plug circumferential direction. Furthermore, the angle θ1 is preferably less than or equal to 90° in terms that starting points of an electrical discharge are likely to be on the projection 420 and the ground electrode 21.

Figure 6:
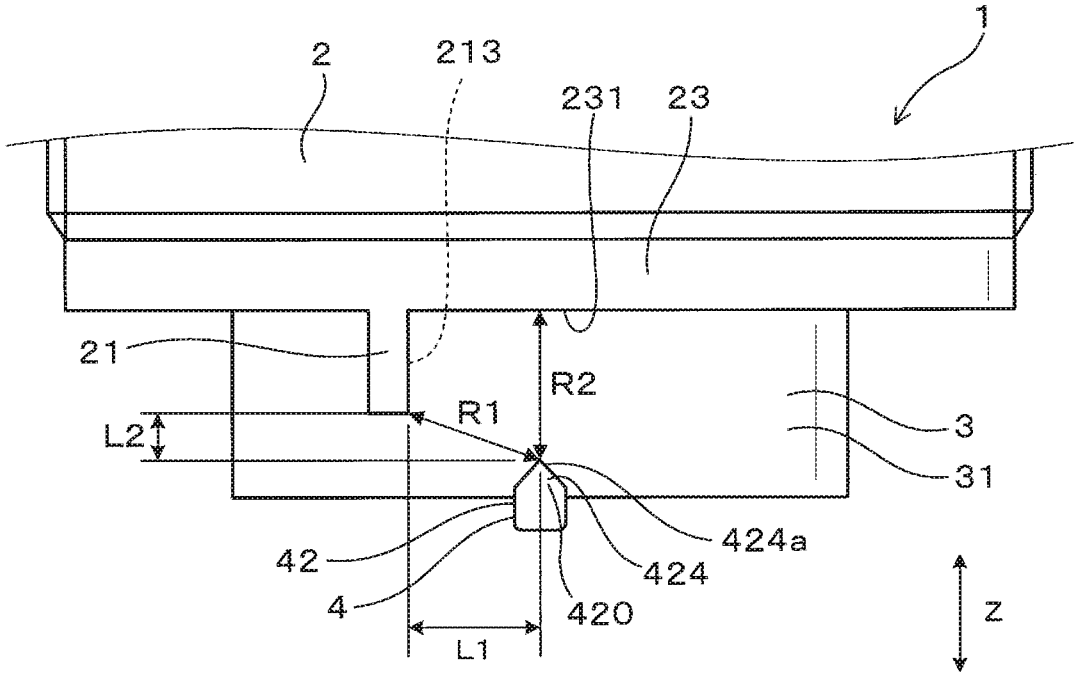
FIG. 6 is a developed view of the spark plug developed in the plug circumferential direction when the distal end portion of the spark plug according to the first embodiment is viewed from the outer circumference.

As shown in FIG. 6, when the shortest spatial path from the ground electrode 21 to the projection 420 is referred to as a first path R1, a length L1 of the first path R1 in the direction orthogonal to the plug axial direction Z is longer than a length L2 of the first path R1 in the plug axial direction Z. The shortest spatial path between two sections refers to a path that connects the two sections in a shortest spatial distance. The first path R1 connects the distal end of the electrical discharge formation corner 213 of the ground electrode 21 to the projection end 424*a* of the pointed portion 424 of the projection 420. On the surface parallel to both the first path R1 and the plug axial direction Z, the length L1 of the first path R1 in the direction orthogonal to the plug axial direction Z is longer than the length L2 of the first path R1 in the plug axial direction Z.

As shown in FIG. 6, the first path R1 is shorter than a second path R2, which is the shortest spatial path from the section of the housing 2 other than the ground electrode 21 to the projection 420. The second path R2 connects the projection end 424*a* to the section of the distal end surface 231 of the distal end cylindrical portion 23 of the housing 2 on the inner circumferential edge at the same position as the projection end 424*a* in the plug circumferential direction.

Although not shown, a resistor is located on the proximal end side of the center electrode 4 in the shaft hole 30 of the insulator 3 with a conductive glass seal located in between. The resistor may be formed by thermally sealing a resistor composition including resistor material, such as a carbon or ceramic powder, and a glass powder or by inserting a cartridge resistor. The glass seal includes a copper glass made by mixing a copper powder in the glass. Also, a terminal stud 11 shown in FIG. 1 is located on the proximal end side of the resistor with a glass seal formed of a copper glass located in between. The terminal stud 11 is formed of, for example, an iron alloy. The proximal end of the terminal stud 11 projects from the insulator 3.

As shown in FIG. 1, a power supply 104 is connected to the section of the terminal stud 11 projecting from the insulator 3 toward the proximal end side. The power supply 104 may be, for example, a common ignition coil, a power supply of an ignition system 10 that is capable of continuously controlling the electrical discharges, or a high-frequency power supply that is capable of applying a high-frequency voltage of, for example, 200 kHz to 5 MHz to the center electrode 4.

Next, the ignition system 10 that is formed by mounting the spark plug 1 of the present embodiment on an internal combustion engine will be described.

As shown in FIG. 1, the ignition system 10 includes the power supply 104, which applies voltages to the spark plug 1. The ignition system 10 includes the engine head 101 on which the spark plug 1 is mounted.

The mounting threaded portion 22 of the spark plug 1 is engaged with the internally threaded bore 103 of the engine head 101. This fastens the spark plug 1 to the engine head 101. The distal end portion of the spark plug 1 is located in the combustion chamber 102.

Figure 7:
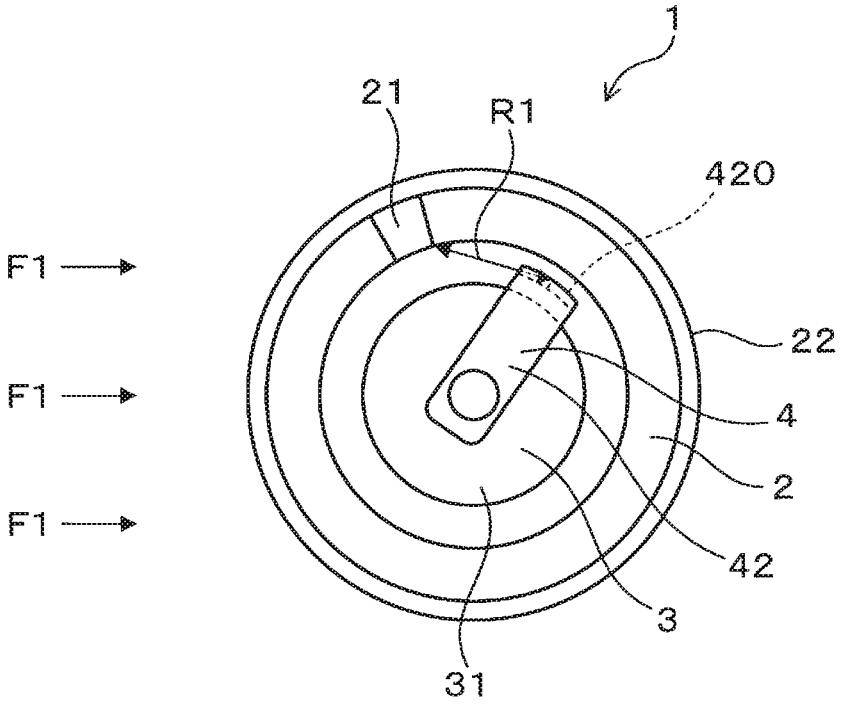
FIG. 7 is a plan view of the distal end portion of the spark plug for describing the flow direction of a main gas stream according to the first embodiment.

As shown in FIG. 7, when the spark plug 1 is viewed from the plug axial direction Z, the first path R1 in the plug circumferential direction is located on one side of the insulator 3 in the direction orthogonal to a later-described flowing direction F1 of a main gas stream of the air-fuel mixture. Thus, a part of the spark plug 1 is not likely to be located on either side of the first path R1 in the flowing direction F1 of the main gas stream, and the main gas stream is allowed to pass through the surrounding portions of the first path R1 easily.

In the present embodiment, in particular, unless otherwise specified, the flow of the air-fuel mixture passing the distal end portion of the spark plug 1 refers to the flow of the air-fuel mixture that passes the distal end portion of the spark plug 1 at the engine ignition timing. The flow of the air-fuel mixture may include a main gas stream that is generally in a constant direction in multiple cycles and a side stream that flows in a direction different from the flowing direction of the main gas stream due to the occurrence of, for example, a turbulent flow and swirls. The flowing direction of the main gas stream of the air-fuel mixture is, for example, a direction from the section where an intake valve is located to the section where an exhaust valve is located in the internal combustion engine. That is, the flowing direction of the main gas stream may be parallel to the direction in which the intake valve and the exhaust valve are located.

The mounting position of the spark plug 1 on the internal combustion engine is adjusted with consideration given to the flowing direction F1 of the main gas stream of the air-fuel mixture passing the distal end portion of the spark plug 1. The mounting position may be adjusted by, for example, the manner in which the mounting threaded portion 22 of the housing 2 is threaded. The adjustment of the mounting position of the spark plug 1 on the internal combustion engine is not limited to this. For example, a spacer or a gasket may be provided on the proximal end side of the mounting threaded portion 22 to be sandwiched between the engine head 101 and the housing 2, and the position of the spark plug 1 may be adjusted by adjusting the stopping position of the spark plug 1 screwed to the engine head 101 with the spacer or the gasket.

Next, FIGS. 8 to 11 show one example of a manner in which a discharge spark S generated by the spark plug 1 is extended by the side stream in the combustion chamber 102. In FIGS. 8 to 11, the example in which the first path (refer to the reference sign R1 in FIG. 7) is formed at the most downstream position of the side stream will be described.

First, the flowing direction F2 of the side stream will be described using FIG. 8. When the side stream passes the outer circumferential surface of the insulator tip 31, the traveling direction of the side stream curves along the outer circumferential surface of the insulator tip 31. At least part of the side stream passes at least part of the first path (refer to the reference sign R1 in FIG. 7) in the vicinity of the downstream side of the insulator tip 31.

Figure 10:
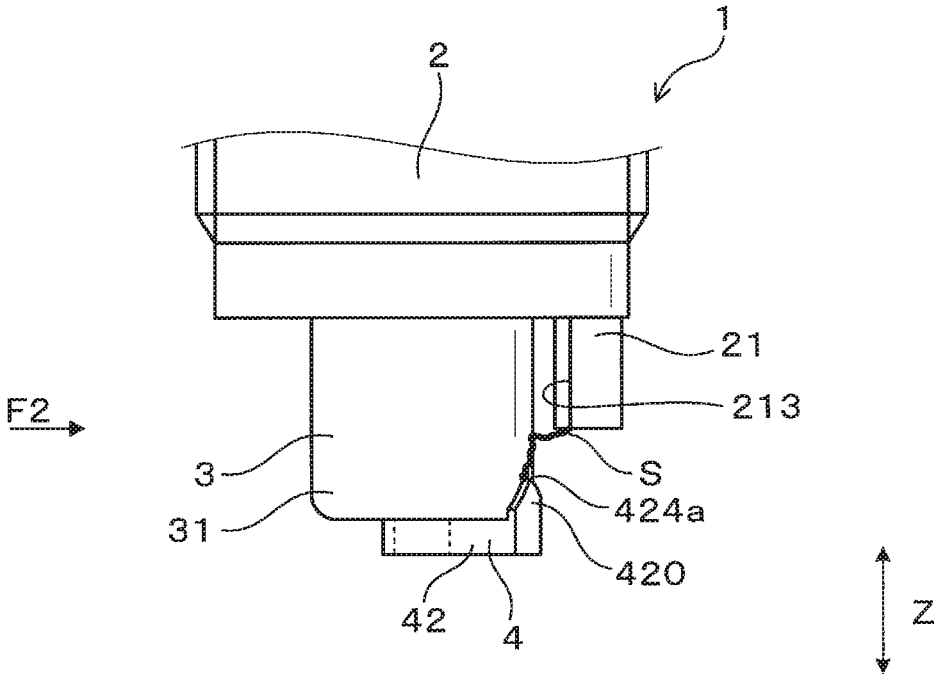
FIG. 10 is a view of the spark plug shown in FIG. 8 as viewed from the direction of arrow X.
Figure 11:
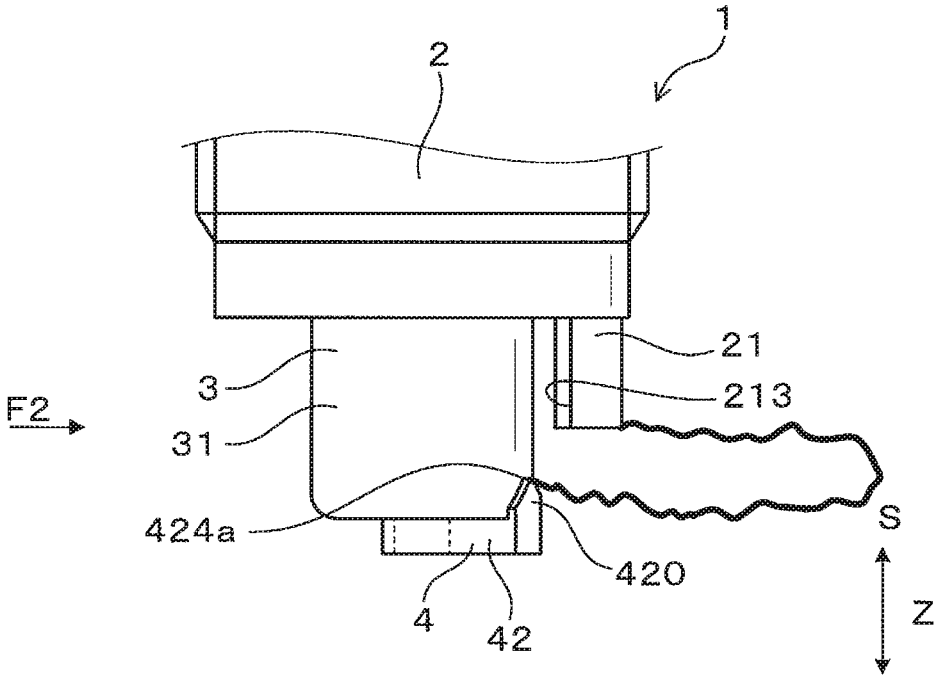
FIG. 11 is a view of the spark plug shown in FIG. 9 as viewed from arrow XI.

Next, the manner in which the discharge spark S is extended will be described. First, as shown in FIGS. 8 and 10, the electrical discharge of the spark plug 1 is generated with the distal end of the electrical discharge formation corner 213 of the ground electrode 21 and the projection end 424*a* of the projection 420 serving as the starting points. Unless otherwise specified, the electrical discharge refers to the initial electrical discharge caused between the ground electrode 21 and the center electrode 4.

Figure 8:
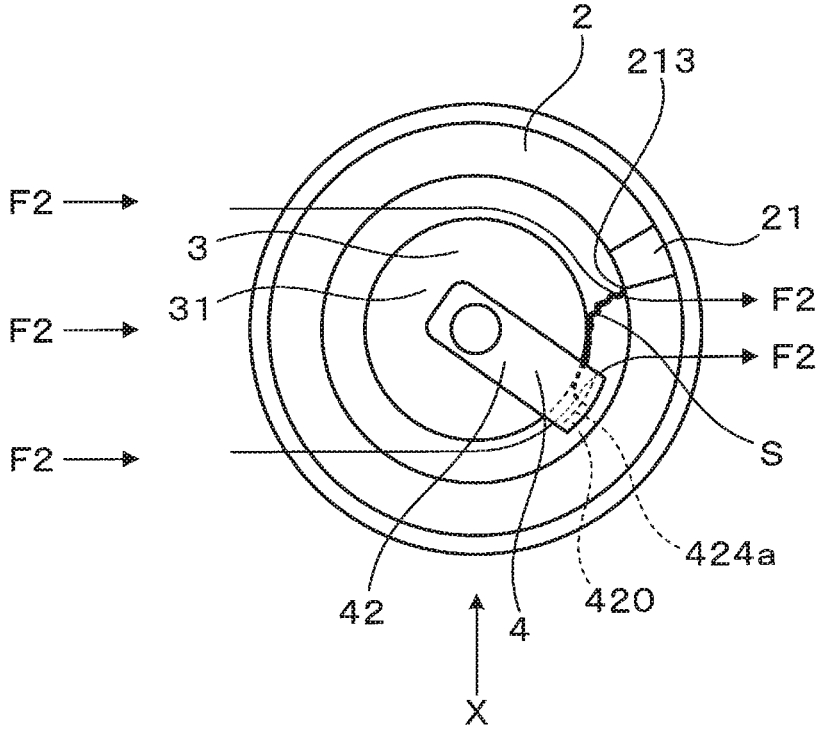
FIG. 8 is a plan view of the distal end portion of the spark plug according to the first embodiment and is an explanatory diagram illustrating an initial discharge spark.
Figure 9:
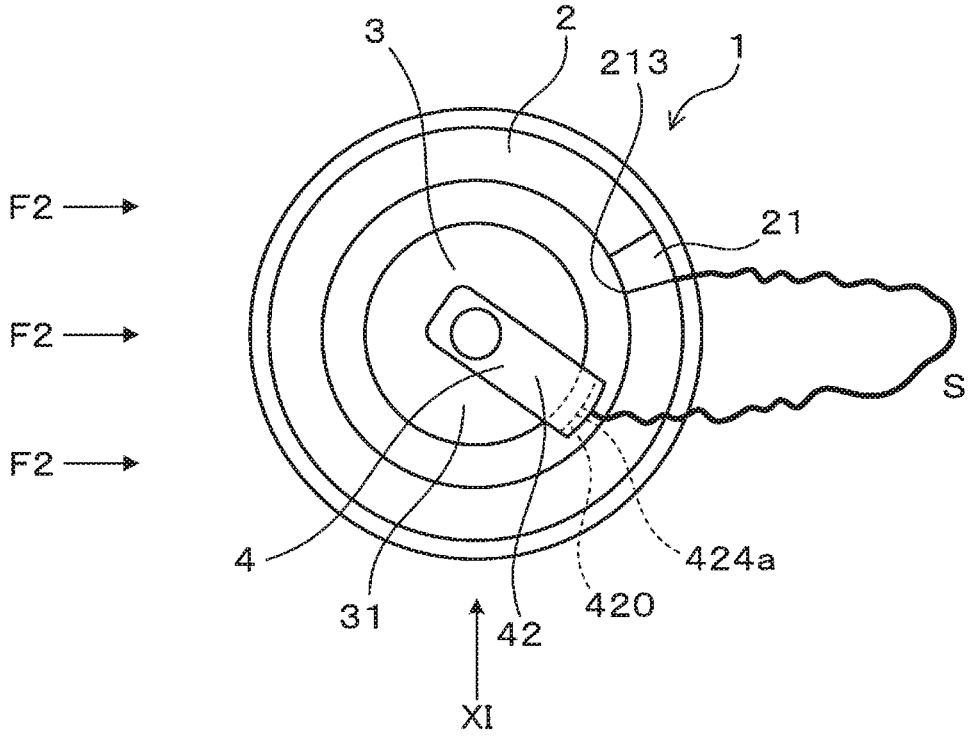
FIG. 9 is a plan view of the distal end portion of the spark plug according to the first embodiment and is an explanatory diagram illustrating the manner in which the discharge spark is greatly extended by a side stream of an air-fuel mixture in a combustion chamber.

As shown in FIGS. 8 and 10, part of the discharge spark S generated by the electrical discharge between the starting points creeps along the outer circumferential surface of the insulator tip 31. Since the ground electrode 21 and the projection 420 of the center electrode 4 are located at different positions in the plug circumferential direction, the discharge spark S is formed in a spiral fashion in one direction of the plug circumferential direction as it extends from one end to the other end in the plug axial direction Z. Thus, the discharge spark S is formed in a certain range in the plug circumferential direction.

As shown in FIGS. 8 to 11, at least part of the discharge spark S is pulled toward the downstream side of the side stream by the side stream that passes between the electrical discharge formation corner 213 and the projection end 424*a* of the projection 420 in the plug circumferential direction. Thus, the discharge spark S is separated from the surface of the insulator 3 and is greatly extended to the downstream side of the side stream. This increases the contact area between the discharge spark S and the air-fuel mixture and improves the ignition performance of the spark plug 1 to the air-fuel mixture. As described above, in the present embodiment, even if the side stream occurs in the combustion chamber, the ignition performance of the spark plug 1 is sufficient.

Next, the operational advantages of the spark plug of the present embodiment will be described.

In the spark plug 1 of the present embodiment, the projection 420 and the ground electrode 21 are located at different positions in the plug circumferential direction. Thus, the creeping discharge along the surface of the insulator 3 that occurs between the center electrode 4 and the ground electrode 21 is formed in a spiral fashion to extend in one direction in the plug circumferential direction as it extends from one end to the other end in the plug axial direction Z. That is, the creeping discharge is formed in a range having a certain length in the plug circumferential direction. Therefore, even if the direction of the flow in the combustion chamber 102 fluctuates, at least part of the discharge spark caused by the creeping discharge is likely to be located in the region where the discharge spark is easily extended by the flow in the combustion chamber 102. Thus, the spark plug 1 of the present embodiment is unlikely to cause variation in the ignition performance due to the fluctuation of the flow direction of the air-fuel mixture in the combustion chamber 102 and easily improves the ignition performance. Furthermore, as the electrical discharge is formed in a range having a certain length in the plug circumferential direction, a flame is easily formed in the combustion chamber 102 from the range having a certain length in the plug circumferential direction and is easily spread in the combustion chamber 102.

In the present embodiment, in particular, the outside electrode portion 42 includes the extended portion 423, which extends from the boundary with the inside electrode portion 41 toward the outer circumferential side in the plug radial direction, and the projection 420, which projects from the extended portion 423 toward the proximal end side. Thus, the creeping discharge that occurs in the spark plug 1 is unlikely to be formed along the distal end surface of the insulator tip 31 and is mainly or entirely formed along the outer circumferential surface of the insulator tip 31. This increases the length of the creeping discharge along the outer circumferential surface of the insulator tip 31 in the plug circumferential direction. Thus, even if the direction of the flow in the combustion chamber 102 fluctuates, at least part of the discharge spark caused by the creeping discharge is more likely to be located in the region where the discharge spark is easily extended by the flow in the combustion chamber 102.

In the present embodiment, in particular, the shortest spatial path from the ground electrode 21 to the projection 420 is referred to as the first path R1, and the length of the first path R1 in the direction orthogonal to the plug axial direction Z is longer than the length of the first path R1 in the plug axial direction Z. This also increases the length of the creeping discharge in the plug circumferential direction.

In the present embodiment, in particular, the first path R1, which is the shortest spatial path from the ground electrode 21 to the projection 420, is shorter than the second path, which is the shortest spatial path from the section of the housing 2 other than the ground electrode 21 to the projection 420. Thus, the creeping discharge is reliably caused between the ground electrode 21 and the projection 420. That is, the creeping discharge is prevented from being caused between, for example, the distal end surface 231 of the distal end cylindrical portion 23 of the housing 2 and the projection 420 of the center electrode 4. Thus, the spiral creeping discharge is reliably generated between the ground electrode 21 and the projection 420, and the ignition performance of the spark plug 1 to the air-fuel mixture is easily improved.

As described above, the present embodiment provides the spark plug for an internal combustion engine that easily improves the ignition performance.

Second Embodiment

Figure 12:
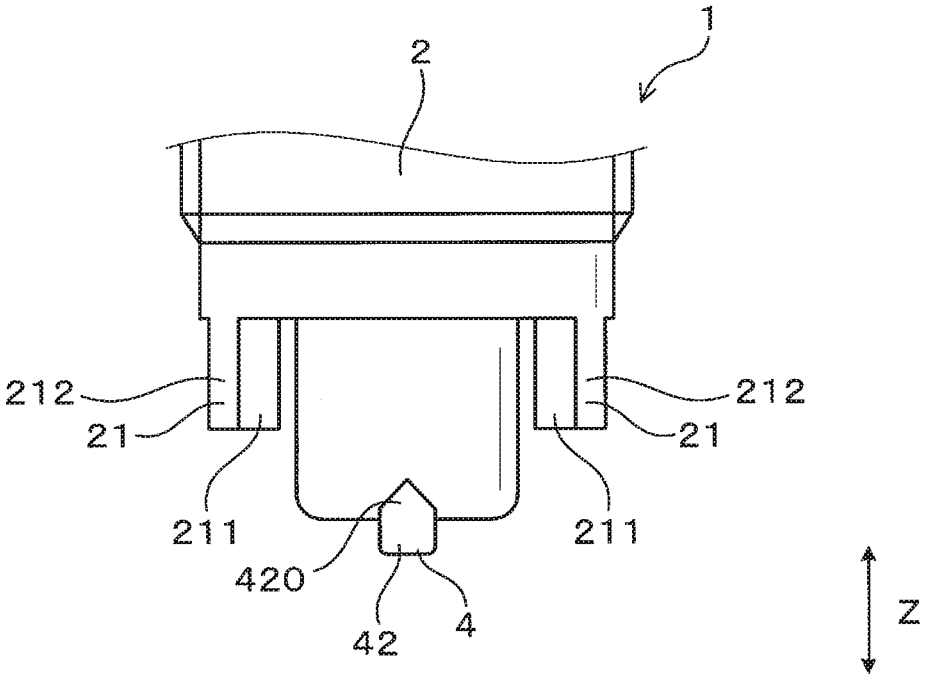
FIG. 12 is a front view of the distal end portion of a spark plug according to a second embodiment.
Figure 13:
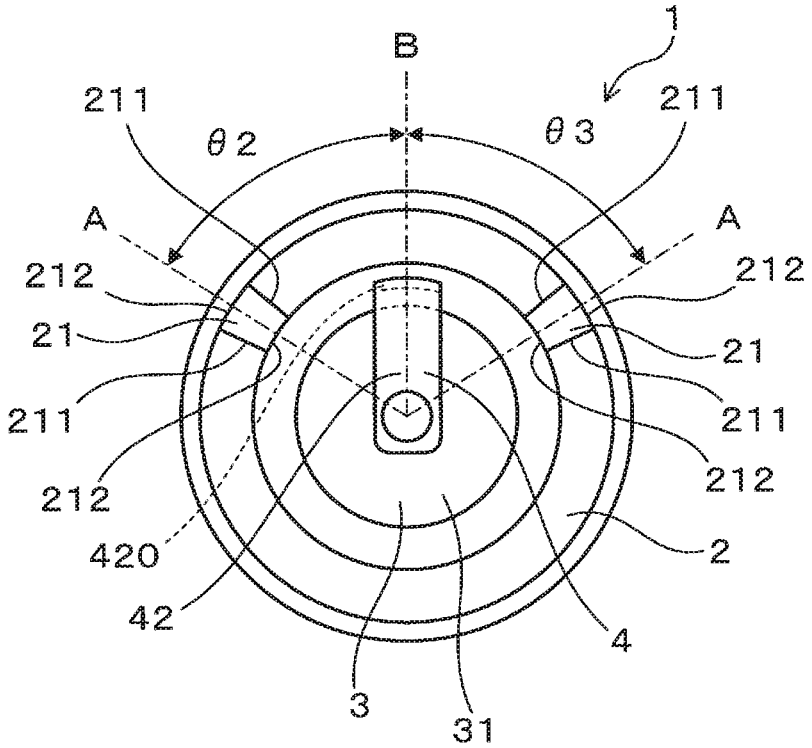
FIG. 13 is a plan view of the distal end portion of the spark plug according to the second embodiment.

The present embodiment is an embodiment in which the housing 2 includes multiple ground electrodes 21 as shown in FIGS. 12 and 13. In the present embodiment, two ground electrodes 21 are formed on the housing 2.

The two ground electrodes 21 have the same shape as each other, but are located at different positions from each other. The two ground electrodes 21 are located at positions separate from each other in the plug circumferential direction on both sides of the projection 420 of the electrode 4. The projection 420 and the ground electrodes 21 are alternately arranged in the plug circumferential direction at equal intervals. As shown in FIG. 13, each ground electrode 21 includes the pair of first side surfaces 211 facing the plug circumferential direction and the pair of second side surfaces 212 facing the plug radial direction.

As shown in FIG. 13, when the spark plug 1 is viewed from the plug axial direction Z, an angle θ2 between a first straight line A defined by one of the ground electrodes 21 and a second straight line B and an angle θ3 between a first straight line A defined by the other one of the ground electrodes 21 and the second straight line B are comparable to each other, or preferably the same. Like the first embodiment, the first straight line A is a straight line that connects the center of each ground electrode 21 in the plug circumferential direction to the plug central axis in the plug radial direction when the spark plug 1 is viewed from the plug axial direction Z. Like the first embodiment, the second straight line B is a straight line that connects the center of the projection 420 in the plug circumferential direction to the plug central axis in the plug radial direction when the spark plug 1 is viewed from the plug axial direction Z.

Other structures are the same as the first embodiment.

The reference signs used in and after the second embodiment that are the same as the reference signs in the previously described embodiment refer to the same components as those in the previously described embodiment unless otherwise specified.

In the present embodiment, the housing 2 includes the ground electrodes 21. Thus, even if one of the ground electrodes 21 wears out due to the repetitive electrical discharge, the other ground electrode 21 can form an electrical discharge. This allows an electrical discharge to be formed between the center electrode 4 and the ground electrodes 21 for a long term and easily increases the life of the spark plug 1.

Additionally, the spark plug 1 of the present embodiment achieves the same operational advantages as those of the first embodiment.

Third Embodiment

Figure 14:
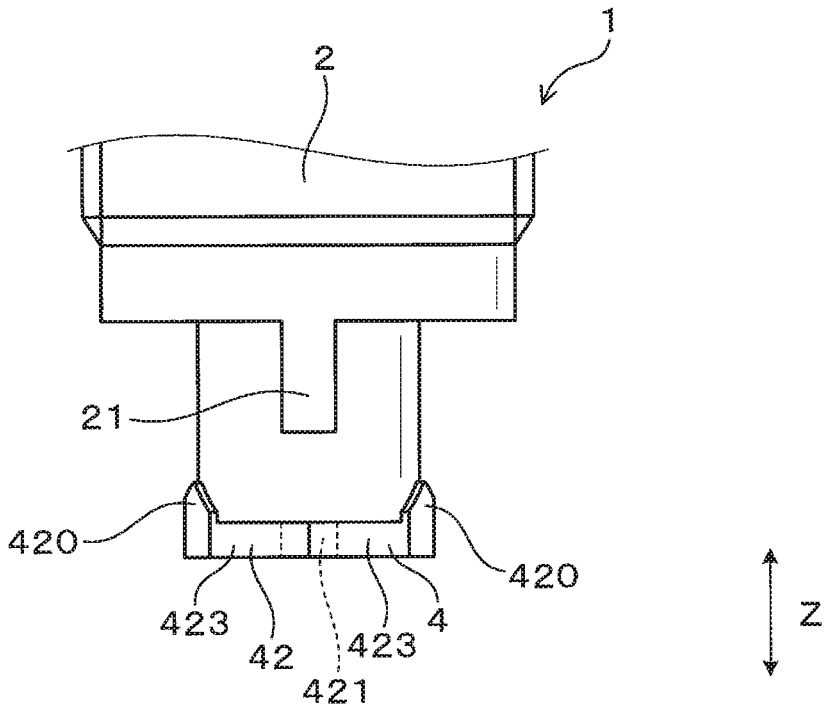
FIG. 14 is a front view of the distal end portion of a spark plug according to a third embodiment.
Figure 15:
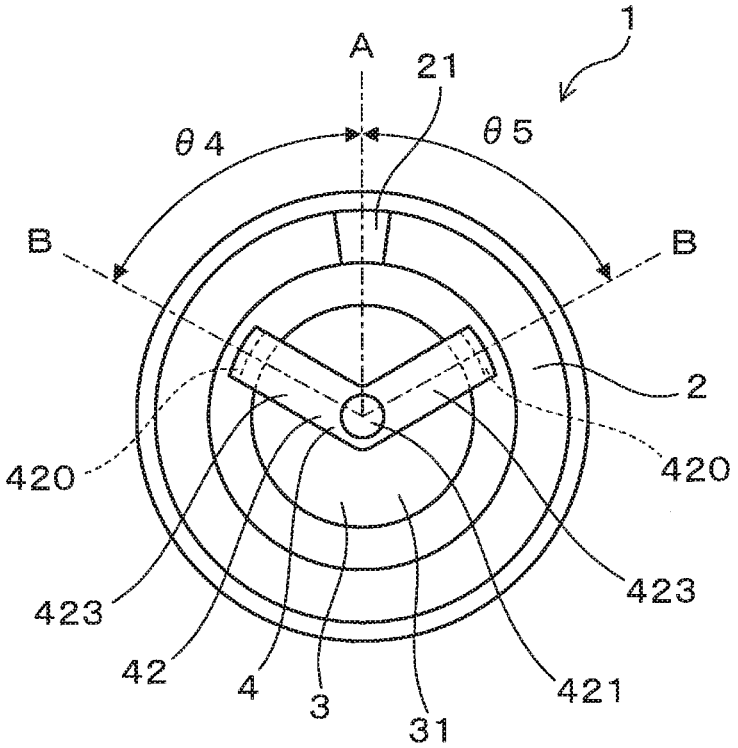
FIG. 15 is a plan view of the distal end portion of the spark plug according to the third embodiment.

The present embodiment is an embodiment in which the outside electrode portion 42 includes multiple projections 420 as shown in FIGS. 14 and 15. In the present embodiment, the outside electrode portion 42 includes two projections 420.

The mounting member 422 of the outside electrode portion 42 includes two extended portions 423, which extend from the cylindrical portion 421 and formed at different positions from each other in the plug circumferential direction, and two projections 420, which project from the outer circumferential end of the two extended portions 423 toward the proximal end side. The two projections 420 are located on both sides of the ground electrode 21 separate from the ground electrode 21 in the plug circumferential direction. The projections 420 and the ground electrode 21 are alternately arranged at equal intervals in the plug circumferential direction. The extended portion 423 and the projection 420 that are formed in one direction of the plug circumferential direction have the same shapes as and located at different positions from the extended portion 423 and the projection 420 that are formed in the other direction of the plug circumferential direction.

As shown in FIG. 15, when the spark plug 1 is viewed from the plug axial direction Z, an angle θ4 formed between a second straight line B defined by one of the projections 420 and a first straight line A, and an angle θ5 formed between a second straight line B defined by the other projection 420 and the first straight line A are comparable to each other, or preferably the same. Other structures are the same as those of the first embodiment.

In the present embodiment, the outside electrode portion 42 includes the projections 420. Thus, even if one of the projections 420 wears out due to the repetitive electrical discharge, the other projection 420 can form an electrical discharge. This allows an electrical discharge to be formed between the center electrode 4 and the ground electrode 21 for a long term and easily increases the life of the spark plug 1.

Additionally, the spark plug 1 of the present embodiment achieves the same operational advantages as those of the first embodiment.

Fourth Embodiment

Figure 16:
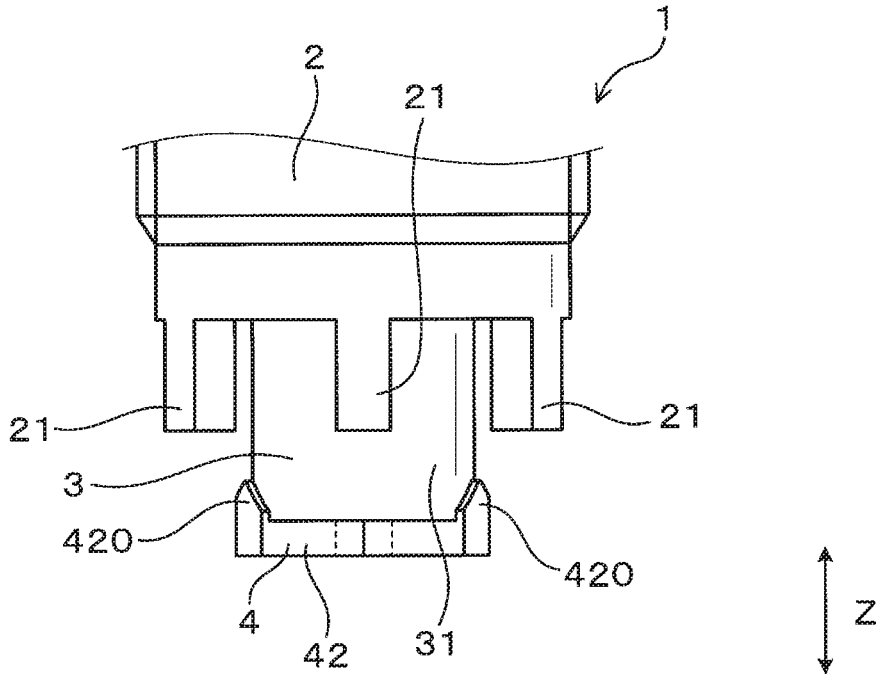
FIG. 16 is a front view of the distal end portion of a spark plug according to a fourth embodiment.
Figure 17:
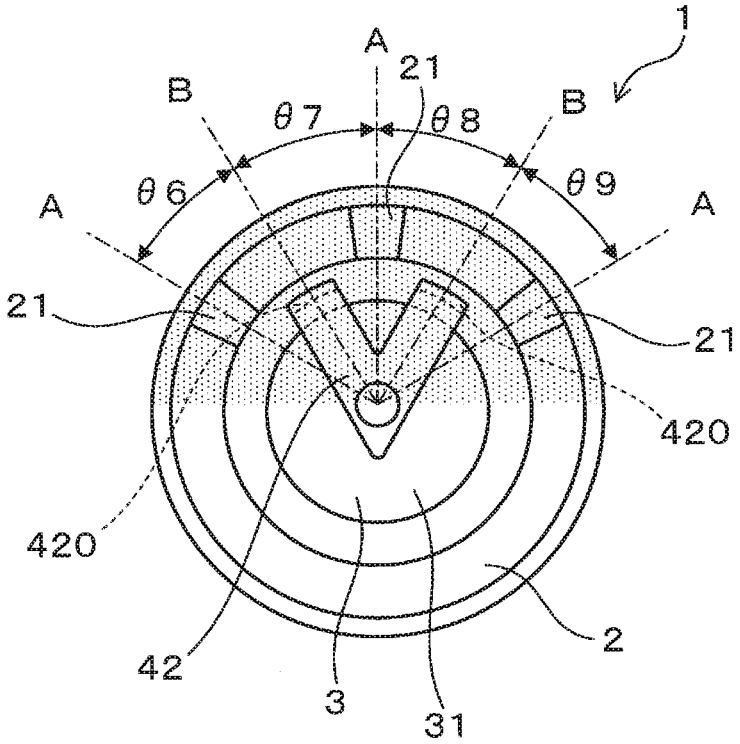
FIG. 17 is a plan view of the distal end portion of the spark plug according to the fourth embodiment.

The present embodiment includes multiple ground electrodes 21 and multiple projections 420 as shown in FIGS. 16 and 17. In the present embodiment, the housing 2 includes three ground electrodes 21, and the center electrode 4 includes two projections 420.

The spark plug 1 of the present embodiment includes the three ground electrodes 21 and the two projections 420. The ground electrodes 21 and the projections 420 are alternately arranged in the plug circumferential direction at equal intervals.

FIG. 17 shows three first straight lines A defined by the three ground electrodes 21 and two second straight lines B defined by the two projections 420. When the spark plug 1 is viewed from the plug axial direction Z, an angle between the first straight line A and the second straight line B that are adjacent to each other in the circumferential direction will be referred to as θ6, θ7, θ8, and θ9 in the order from one end in the plug circumferential direction. The angles θ6, θ7, θ8, and θ9 are comparable to each other, or preferably the same.

In the present embodiment, the angle between the first straight line A located on one end in the plug circumferential direction and the first straight line A located on the other end in the plug circumferential direction is less than or equal to 180°. Additionally, the range in which the ground electrodes 21 and the projections 420 are formed in the plug circumferential direction is within a region in which the central angle about the plug central axis is 180° (for example, the region of the shaded area in FIG. 17).

Other structures are the same as those in the first embodiment.

The present embodiment provides the operational advantages that are the same as those of the second embodiment and the third embodiment.

Fifth Embodiment

Figure 18:
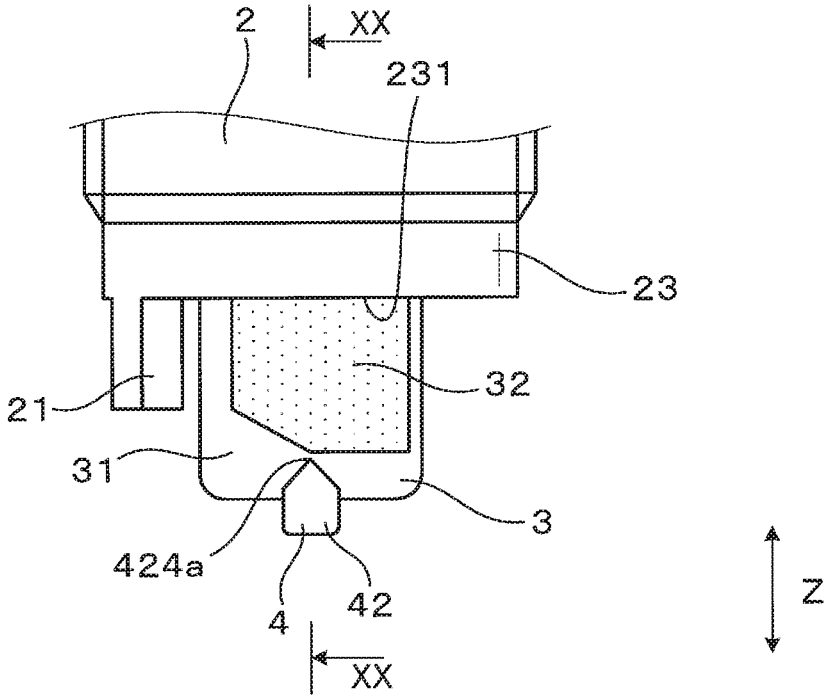
FIG. 18 is a front view of the distal end portion of a spark plug according to a fifth embodiment.
Figure 19:
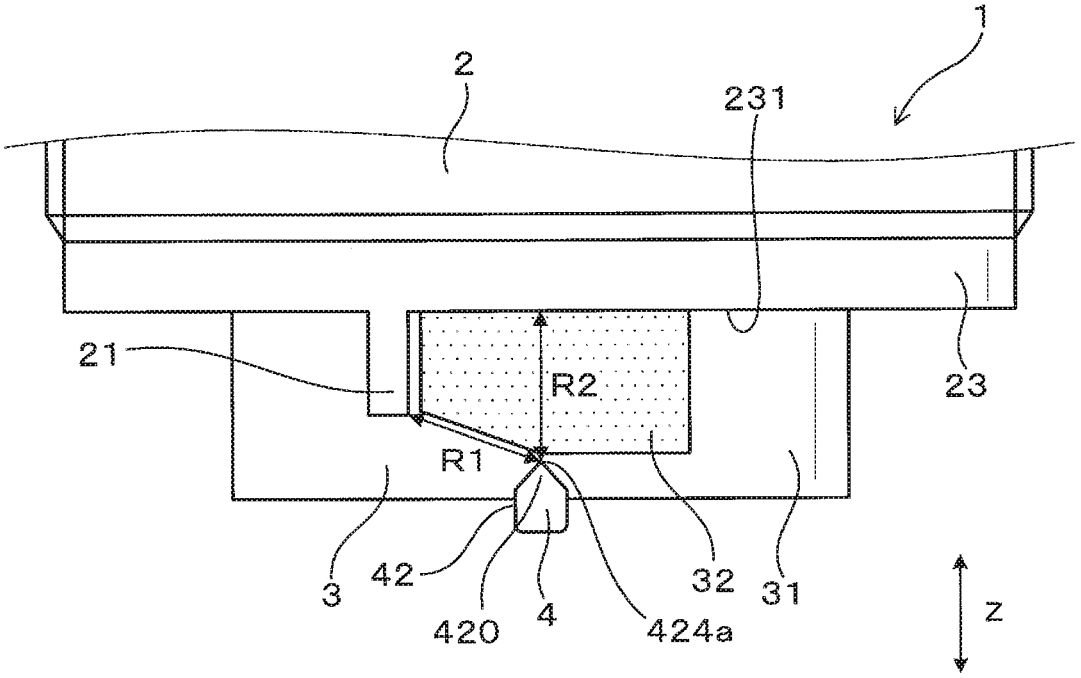
FIG. 19 is a developed view of the spark plug developed in the plug circumferential direction when the distal end portion of the spark plug according to the fifth embodiment is viewed from the outer circumference.
Figure 20:
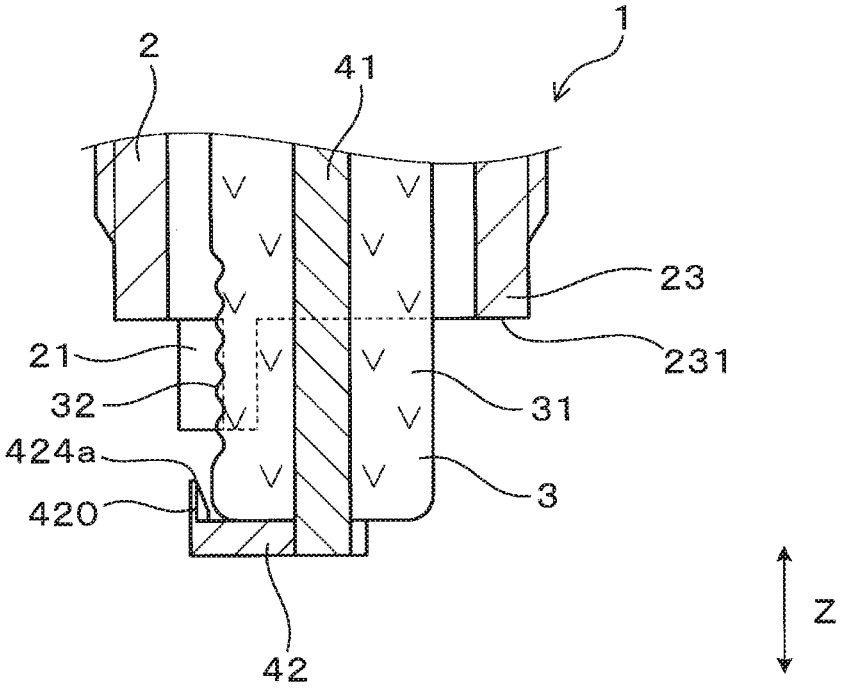
FIG. 20 is a cross-sectional view of the spark plug taken along line XX-XX of FIG. 18.

As shown in FIGS. 18 to 20, the present embodiment is an embodiment with corrugations formed on the surface of the insulator 3 according to the first embodiment. In FIGS. 18 and 19, the corrugations are omitted, and the range in which the corrugations are formed is represented by a shaded area.

Like the first embodiment, the shortest spatial path from the ground electrode 21 to the projection 420 is referred to as the first path R1, and the shortest spatial path from the section of the housing 2 other than the ground electrode 21 to the projection 420 is referred to as the second path R2. As shown in FIG. 19, a second projected region (that is, the region of two-direction arrow R2 in FIG. 19) obtained by projecting the second path R2 onto the surface of the insulator 3 in the plug radial direction includes the corrugations as shown in FIG. 20. As shown in FIG. 19, a first projected region (that is, the region of two-direction arrow R1 in FIG. 19) obtained by projecting the first path R1 onto the surface of the insulator 3 in the plug radial direction is flatter than the second projected region.

The present embodiment includes a corrugated surface 32 in the shaded region of FIG. 19 on the surface of the insulator 3. That is, the corrugated surface 32 is formed from the position slightly separate from the ground electrode 21 and the first path R1 toward the center electrode 4 in the plug circumferential direction to the region on the side of the ground electrode 21 closer to the center electrode 4 in the plug circumferential direction. The corrugated surface 32 extends beyond the center electrode 4 in the plug circumferential direction opposite to the ground electrode 21. The corrugated surface 32 is not formed in the first projected region (that is, the region of two-direction arrow R1 in FIG. 19).

As shown in FIG. 20, the corrugated surface 32 has the corrugations as seen on the cross-section parallel to the plug axial direction Z passing through the plug central axis. In the plug axial direction Z, the corrugated surface 32 is formed from the section slightly separate from the projection end 424*a* of the projection 420 of the outside electrode portion 42 to a region closer to the proximal end side than the distal end surface 231 of the distal end cylindrical portion 23 of the housing 2.

Other structures are the same as those of the first embodiment.

In the present embodiment, the second projected region has the corrugations. Furthermore, the first projected region is formed to be flatter than the second projected region. Thus, the creepage distance on the second projected region is easily increased. Thus, the electrical discharge is easily prevented from being formed along the second projected region, and the electrical discharge is reliably formed between the ground electrode 21 and the projection 420. This easily allows the creeping discharge to be reliably caused between the ground electrode 21 and the projection 420 in a spiral fashion and easily improves the ignition performance of the spark plug 1 to the air-fuel mixture.

Additionally, the spark plug 1 of the present embodiment achieves the same operational advantages as those of the first embodiment.

Sixth Embodiment

Figure 21:
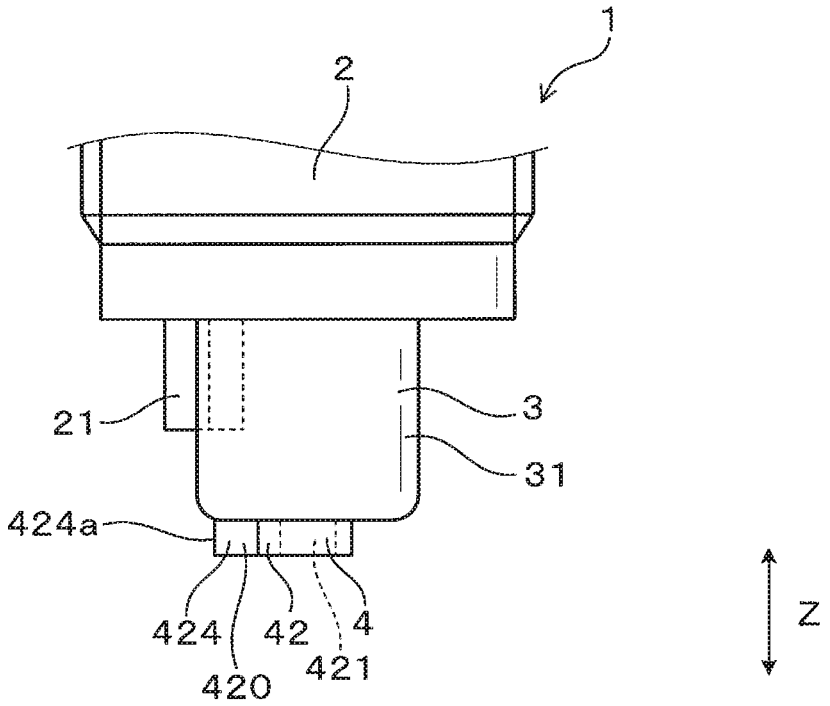
FIG. 21 is a front view of the distal end portion of a spark plug according to a sixth embodiment.
Figure 22:
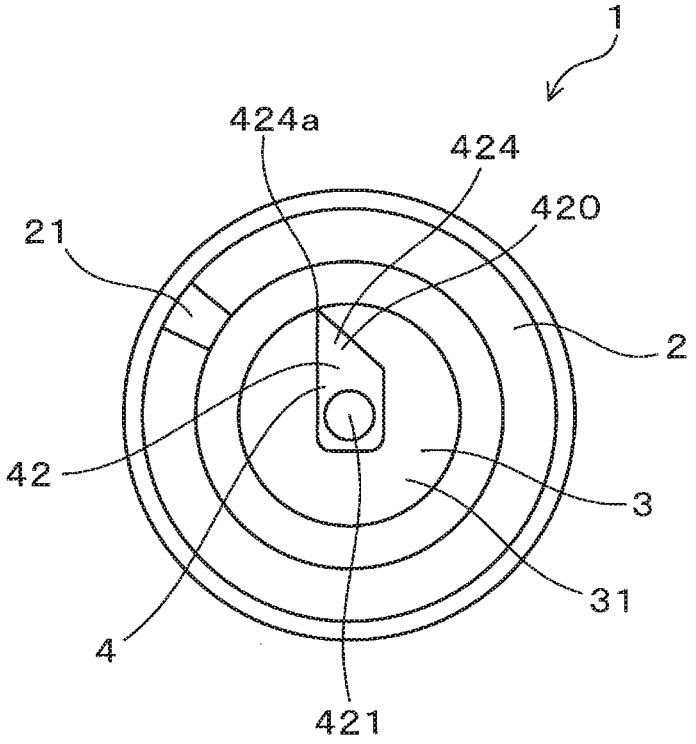
FIG. 22 is a plan view of the distal end portion of the spark plug according to the sixth embodiment.

The present embodiment is an embodiment in which the shape of the outside electrode portion 42 in the first embodiment is modified as shown in FIGS. 21 and 22.

The outside electrode portion 42 includes the cylindrical portion 421 and the projection 420, which projects toward the outer circumferential side in the plug radial direction from a part of the cylindrical portion 421 in the plug circumferential direction. That is, in the present embodiment, the outside electrode portion 42 is not formed in the region closer to the proximal end side than the distal end surface of the insulator 3.

The projection 420 includes the pointed portion 424 at the outer circumferential end. The pointed portion 424 is tapered so that the side surface of the pointed portion 424 further from the ground electrode 21 in the plug circumferential direction approaches the ground electrode 21 in the plug circumferential direction as the side surface extends toward the outer circumferential side in the plug radial direction. The projection end 424*a* of the pointed portion 424 is the end of the pointed portion 424 closer to the ground electrode 21 in the plug circumferential direction and is formed on the outer circumferential end in the plug radial direction.

Other structures are the same as those of the first embodiment.

The present embodiment also achieves the same operational advantages as those of the first embodiment.

The present disclosure is not limited to each of the embodiments and may be applied to various embodiments without departing from the scope of the invention. Each of the above embodiments may be applied to the spark plug according to the present disclosure alone, or may be combined with another embodiment to be applied to the spark plug according to the present disclosure. Each of the embodiments may be applied instead of the structure described in another embodiment of the present disclosure, or may be added to the structure described in another embodiment of the present disclosure.

What is claimed is:

1. A spark plug for an internal combustion engine comprising:

a cylindrical housing;

a cylindrical insulator retained inside the housing with an insulator tip projecting from the housing toward a distal end side of the housing; and a center electrode including an inside electrode portion located inside the insulator and an outside electrode portion exposed from the insulator toward the distal end side of the insulator, wherein the housing includes a ground electrode projecting from a distal end portion of the housing toward the distal end side of the plug at a part in a plug circumferential direction, the outside electrode portion projects along a surface of the insulator tip in a direction away from a boundary with the inside electrode portion and includes a projection, which is capable of causing an electrical discharge between the ground electrode and the outside electrode portion, the projection is formed in a region in the plug circumferential direction, and the projection and the ground electrode are located at positions different from each other in the plug circumferential direction.

2. The spark plug for an internal combustion engine according to claim 1, wherein the outside electrode portion includes an extended portion, which extends from the boundary with the inside electrode portion toward an outer circumferential side in a plug radial direction, and the projection projects from the extended portion toward a proximal end side.

3. The spark plug for an internal combustion engine according to claim 2, wherein a shortest spatial path from the ground electrode to the projection is a first path, and the length of the first path in a direction orthogonal to a plug axial direction is longer than the length of the first path in the plug axial direction.

4. The spark plug for an internal combustion engine according to claim 1, wherein the outside electrode portion includes a plurality of the projections.

5. The spark plug for an internal combustion engine according to claim 1, wherein the housing includes a plurality of the ground electrodes.

6. The spark plug for an internal combustion engine according to claim 1, wherein a first path, which is a shortest spatial path from the ground electrode to the projection, is shorter than a second path, which is a shortest spatial path from a section of the housing other than the ground electrode to the projection.

7. The spark plug for an internal combustion engine according to claim 1, wherein, when a shortest spatial path from the ground electrode to the projection is defined as a first path, and a shortest spatial path from a section of the housing other than the ground electrode to the projection is defined as a second path, a second projected region, which is obtained by projecting the second path on a surface of the insulator in the plug radial direction, includes corrugations, and a first projected region, which is obtained by projecting the first path on the surface of the insulator in the plug radial direction, is formed to be flatter than the second projected region.

* * * * *